US009814966B2

(12) United States Patent
Gomez et al.

(10) Patent No.: US 9,814,966 B2
(45) Date of Patent: Nov. 14, 2017

(54) ROLLOVER SWITCH FOR AN AMUSEMENT GAME DEVICE

(71) Applicant: Stern Pinball, Inc., Elk Grove Village, IL (US)

(72) Inventors: George A. Gomez, Chicago, IL (US); Thomas M. Kopera, Villa Park, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 15/380,489

(22) Filed: Dec. 15, 2016

(65) Prior Publication Data

US 2017/0095730 A1 Apr. 6, 2017

Related U.S. Application Data

(63) Continuation of application No. 14/528,501, filed on Oct. 30, 2014, now Pat. No. 9,561,430.

(51) Int. Cl.

| | |
|---|---|
| ***A63F 7/02*** | (2006.01) |
| ***A63F 7/30*** | (2006.01) |
| ***G07F 17/38*** | (2006.01) |
| ***G07F 17/32*** | (2006.01) |

(52) U.S. Cl.

CPC ..... *A63F 7/027* (2013.01); *A63F 7/3065* (2013.01); *G07F 17/3246* (2013.01); *G07F 17/38* (2013.01)

(58) Field of Classification Search

CPC ..... A63F 7/022; A63F 7/02
USPC ..... 273/121 R, 121 A, 118 A, 119 A; 446/485, 484, 175, 219, 220; 403/7, 118, 403/200; 411/292

See application file for complete search history.

(56) References Cited

U.S. PATENT DOCUMENTS

| | | | | | |
|---|---|---|---|---|---|
| 4,360,203 | A | * | 11/1982 | Garbark | A63F 7/3065 200/61.11 |
| 4,438,930 | A | * | 3/1984 | Peters | A63F 7/3065 273/127 R |
| 5,509,655 | A | * | 4/1996 | Ugawa | G07F 17/3297 273/118 A |
| 5,529,294 | A | * | 6/1996 | Nordman | A63F 7/3065 273/118 A |
| 5,806,851 | A | * | 9/1998 | Gomez | A63F 7/3075 273/118 A |

(Continued)

OTHER PUBLICATIONS

Sparkfun, Jul. 14, 2011, p. 1 Description.*

*Primary Examiner* — Aarti B Berdichevsky
*Assistant Examiner* — Rayshun Peng
(74) *Attorney, Agent, or Firm* — Greenberg Traurig, LLP

(57) ABSTRACT

A rollover switch has a housing carrying a depressible cover coupled to a switch whereby a depression of the cover in response to contact being made between the cover and an object movable across a first surface of a playfield of an amusement game functions to activate the switch. A mounting collar is sized to be positioned within an opening formed in the playfield wherein the opening extends between a second surface of the playfield and the first surface of the playfield. The mounting collar and the housing of the switch assembly have cooperating features that allow the switch assembly to be adjustably mounted within the mounting collar to thereby allow the cover to be positioned at a desired location relative to the first surface of the playfield.

22 Claims, 4 Drawing Sheets

(56) References Cited

U.S. PATENT DOCUMENTS

| | | | | |
|---|---|---|---|---|
| 2010/0165613 | A1* | 7/2010 | Rorick | F21V 23/0414<br>362/206 |
| 2013/0300058 | A1* | 11/2013 | Stellenberg | A63F 7/027<br>273/121 A |

* cited by examiner

ROLLOVER SWITCH FOR AN AMUSEMENT GAME DEVICE

RELATED APPLICATION INFORMATION

This application claims the benefit of and is a continuation of U.S. application Ser. No. 14/528,501, filed on Oct. 30, 2014, the disclosure of which is incorporated herein by reference in its entirety.

BACKGROUND

Amusement game devices, such as pinball machines, redemption games, etc. of the commercial, e.g., revenue generating, and non-commercial, e.g., home entertainment, type are well known in the art. By way of example, U.S. Pat. No. 5,338,031, U.S. Pat. No. 6,158,737, and U.S. Published Application No. 2007/0026918 illustrate and describe amusement game devices of the type having a cabinet which houses a playfield.

Rollover switches for use on the playfield of such amusement game devices are also known in the art. By way of example, U.S. Pat. No. 4,360,203 ("the '203 patent") illustrates and describes a rollover switch having a switch actuator, comprised of a deformable star shaped cover element coupled to a plunger, a support structure for supporting the switch actuator upon the playfield, and a leaf switch which, when activated by the plunger in response to a ball rolling over the star shaped cover element, functions to send a signal to a processing device of the amusement game. The described rollover switch also includes a lamp which can be illuminated to, for example, indicate that the rollover switch is available for scoring, to indicate that the player has completed or achieved actuating or registering of the switch, and/or the like in accordance with the programmed play instructions of the amusement game device.

While rollover switches such as described in the '203 patent generally work for their intended purpose, they do suffer various disadvantages. For example, after the support structure is inserted into the playfield board and glued therein, the entire playfield board must be sanded in order to assure that the support structure is perfectly flush with the playfield board otherwise the ball could skip over the support structure and thereby create an undesirable condition, e.g., the ball can become airborne and miss the cover element preventing activation of the leaf switch, can cause the ball to become hung up on an edge of the support structure (particularly when the rollover switch is placed in a lane with rails or walls on either side), or the like. Because the finishing operations for the playfield, e.g., the application of silkscreened or digitally printed art and the final sprayed protective clear hard coat, usually a self-leveling urethane finish coat, is applied after the support structure is installed and the playfield sanded, it has been seen that the finishing materials, particularly, the clear hard coat, tend to fill, clog, or otherwise impede the movability of one or more components of the actuator switch which thus requires additional finishing operations to be performed to thereby restore the rollover switch to operability. As will be appreciated, the need to perform all of these operations, which are generally too difficult to implement consistently, undesirably adds to the overall cost of manufacture of the amusement game device.

SUMMARY

The following describes an improved rollover switch for an amusement game. Generally, the rollover switch has a housing in which is carried a depressible cover. The depressible cover is coupled to a switch. When the cover is depressed in response to contact being made between the cover and an object that moves across a first surface of a playfield of the amusement game the switch is caused to be activated. For mounting the rollover switch to the playfield of the amusement game a mounting collar is provided. The mounting collar is sized to be positioned within an opening that is formed in the playfield. The mounting collar and the housing of the rollover switch are provided with cooperating features that allow the rollover switch to be adjustably mounted within the mounting collar to thereby allow the cover to be positioned at a desired location relative to the first surface of the playfield.

A better understanding of the objects, advantages, features, properties and relationships of the subject rollover switch will be obtained from the following detailed description and accompanying drawings which set forth illustrative embodiments which are indicative of the various ways in which the principles of the rollover switch may be employed.

BRIEF DESCRIPTION OF THE DRAWINGS

For a better understanding of the rollover switch described hereinafter reference may be had to the following drawings in which.

DETAILED DESCRIPTION

With reference to the Figures, an amusement game device, in the exemplary form of a pinball machine 10 is now described. It is to be appreciated, however, that this exemplary form for the amusement game device 10 is not intended to be limiting. Rather, those of ordinary skill in the art will appreciated that the rollover switch described hereinafter can be utilized in any type of amusement game device of the commercial and non-commercial type in which it is desired to sense an object moving over a sensing switch.

Figure 1:
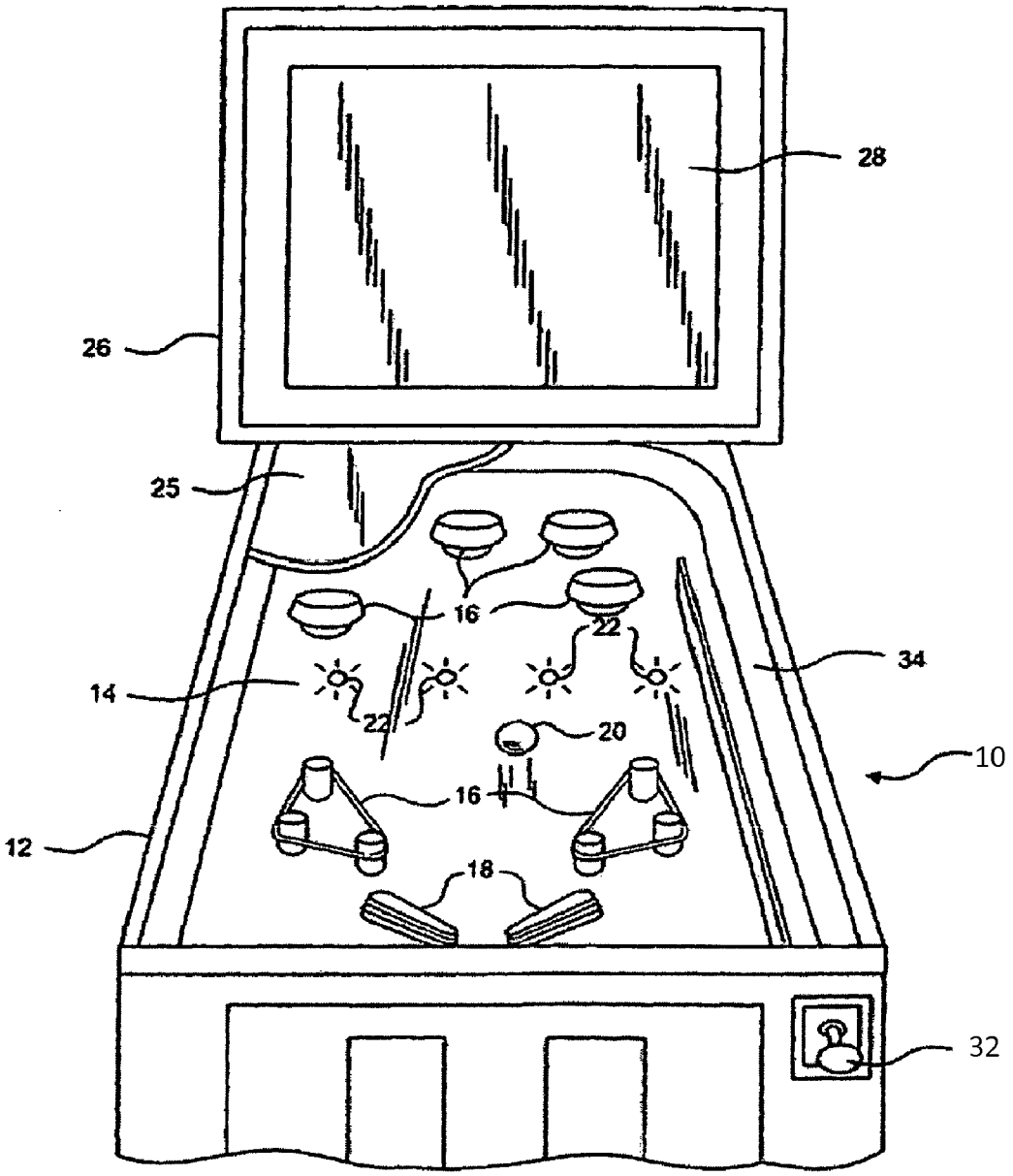
FIG. 1 illustrates an exemplary amusement game device in the form of a pinball machine.

In keeping with the example of an amusement game device 10 of the pinball machine type, the amusement game device 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, game play, in the case of a pinball machine, is defined upon an inclined playfield 14 that supports a number of playfield accessories or devices. More particularly, in the case of a pinball machine, game play is generally defined through the use of a pair of flippers 18 to propel a ball relative to the playfield 14 and input devices/accessories associated with the playfield 14. The playfield 14 is usually inclined from the horizontal such that the ball tends to eventually roll back down the playfield 14 in the direction of the flippers 18. While not intended to be limiting, the playfield accessories or input devices 16 may include elements such as bumpers, ramps, and/or targets as well as one or more rollover switches 22 which will be described in greater detail hereinafter. The playfield 14 may be covered by a transparent or glass sheet cover 25 to permit viewing of the playfield 14. In addition to the foregoing, the playfield 14 includes a plunger element 32 which shoots the ball up an alley 34 onto the playfield 14. The playfield 14 may also include lighting elements—which may also be included as a part of the rollover switches 22—and/or other features as desired. Other player-activated input elements, typically in the form of push-buttons on the sides of the cabinet 12, are usually provided for controlling operation of the flippers 18. The amusement game 10 may also include a backbox 26 which is mounted to overlay a top rear portion of the cabinet 12 and which contains a game display 28, such as a dot matrix display, CRT, LED or plasma display, or the like. The backbox 26 may also support speakers associated with the game sound system. Within the backbox 26 may be located various ones of the electronic devices/circuits for controlling the operation of the playfield, the display, general illumination, and the sound system. Such electronic devices/circuits could also, in whole or in part, be carried within the game cabinet 12.

Figure 2:
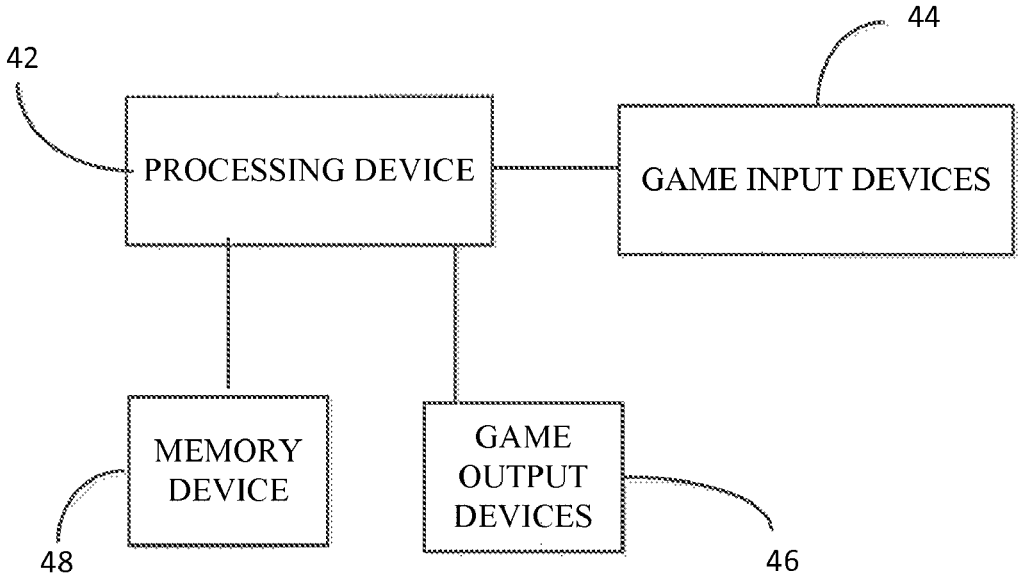
FIG. 2 is an exemplary block diagram of exemplary components of the amusement game device of FIG. 1.

For controlling the various devices that form the amusement game 10, the amusement game 10 is provided with a processing device 42 which processing device 42 is, in turn, coupled to game input devices 44, such as switches associated with the cabinet 12, playfield 14 (including rollover switches 22), etc., and game output devices 46, such as lights (including lights associated with rollover switches 22), flippers 18, display 28, etc. via one or more bus systems as shown in FIG. 2. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
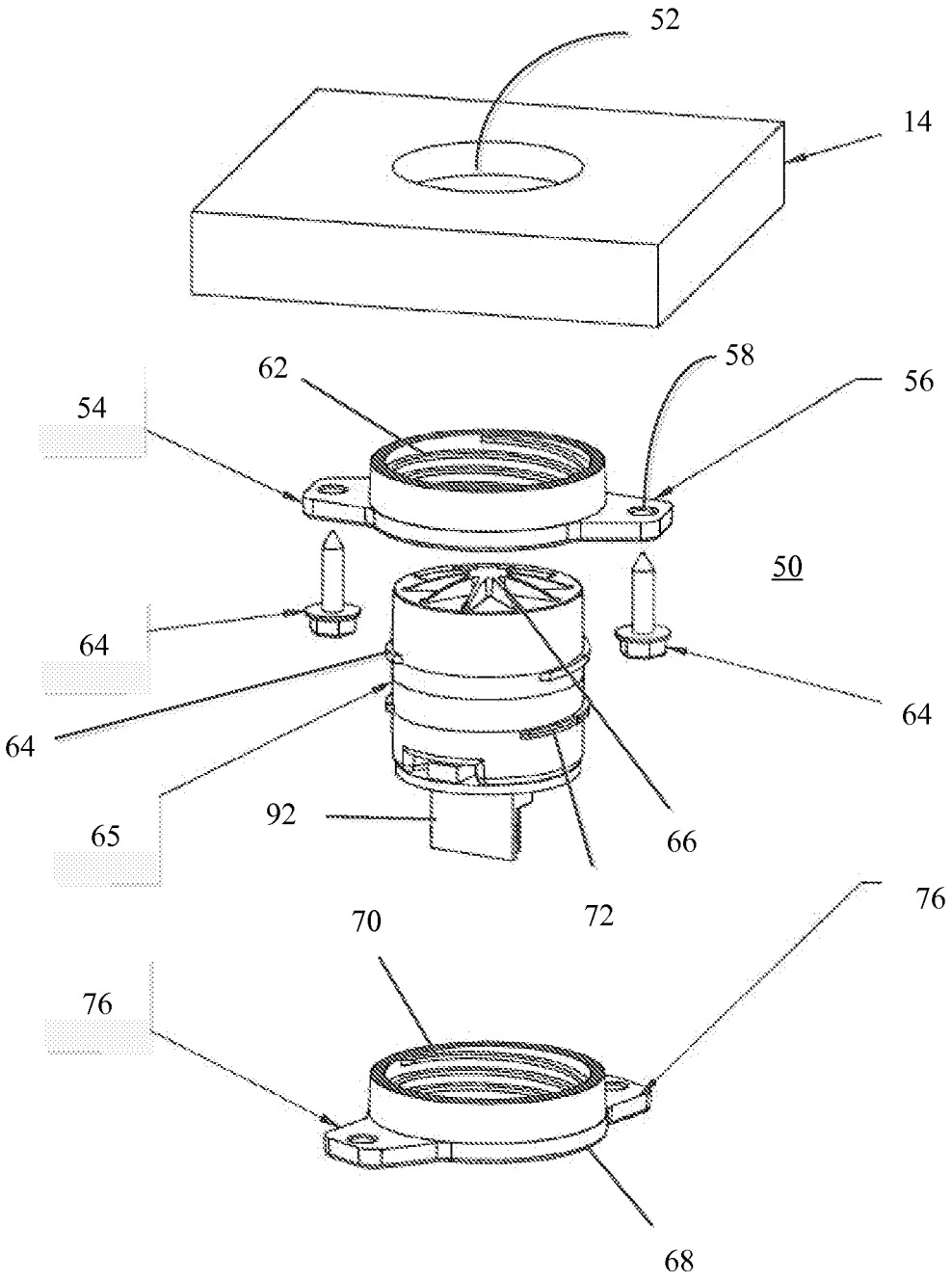
FIG. 3 is an exploded view of a rollerover switch assembly and playfield mounting elements.
Figure 4:
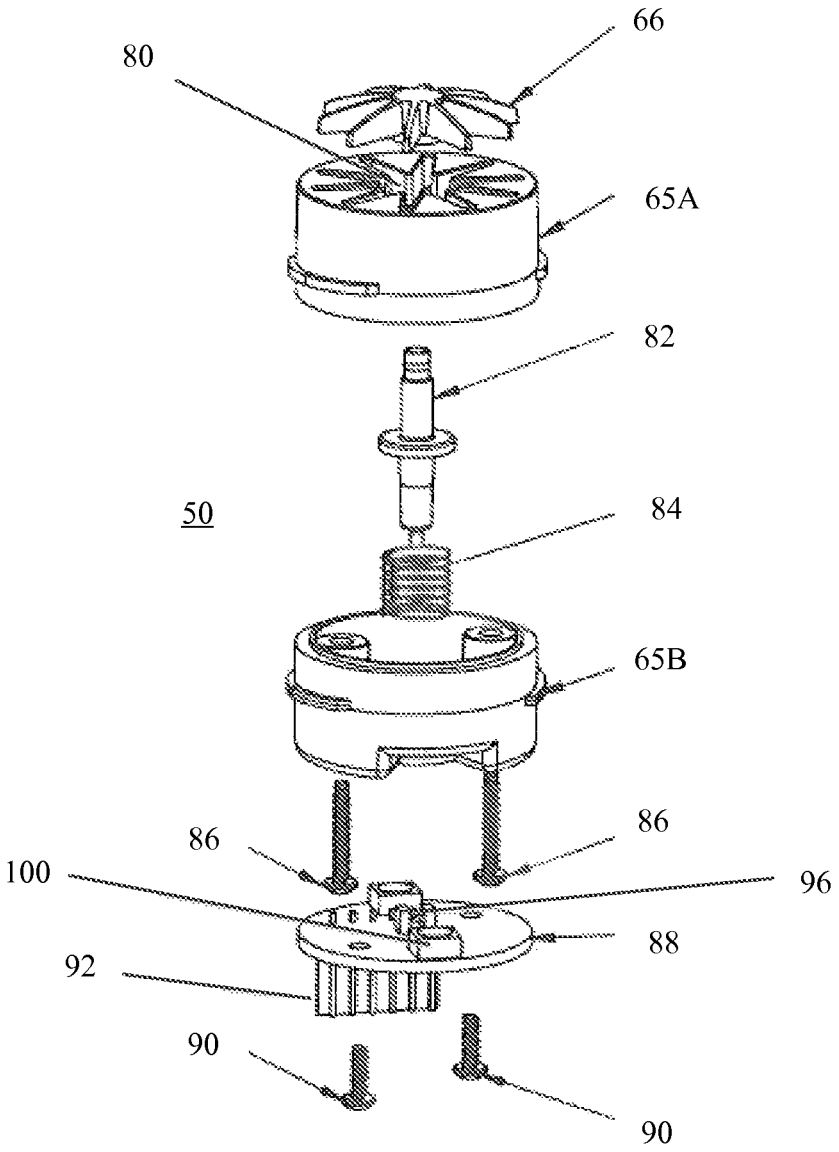
FIG. 4 is an exploded view of the rollover switch assembly of FIG. 3.

Turning now to FIGS. 3 and 4, an exemplary rollover switch assembly and structure for mounting the rollover switch assembly to the playfield 14 is described. Generally, the rollover switch assembly 50 is mounted within an opening 52 that is formed in the playfield 14. To this end, a mounting collar 54, which is adapted to adjustably receive the switch assembly 50, is sized to be fit within the opening 52 of the playfield 14. Extending from the mounting collar 54 are one or more flanges 56 each having a fastener 60 accepting opening 58. As will be appreciated, fasteners 60 are to be passed through the fastener accepting openings 58 to thereby attach the flanges 56 to the underside of the playfield 14 and to thereby mount the mounting collar 54 to the playfield within the opening 52.

For adjustably receiving the switch assembly 50, an interior surface of the mounting collar 54 is provided with a screw thread 62 which is cooperable with a screw thread 64 that is provided to the exterior surface of the housing 65 of the rollover switch assembly 50. In this manner, the rollover switch assembly 50 can be screwed into the mounting collar 54 such that the top of the switch assembly housing 65 is positioned flush to the top surface of the playfield 14 with the rollover switch cover element 66 extending above the top surface of the playfield 14 to thereby allow the rollover switch cover element 66 to be exposed for contact with and depression by a ball rolling thereover as will be discussed in greater detail hereinafter. While the use of the cooperating screw threads 62 and 64 are preferred as it allows the positioning of the switch assembly 50 relative to the top of the playfield 14 to be finely adjusted as desired, it is to be understood that other cooperating adjustment mechanisms can be provided to the switch assembly 50 and mounting collar 54 to meet the above noted objectives.

To maintain the switch assembly 50 within the mounting collar 54 in the desire position, a locking collar 68 is further provided. The locking collar 65 is likewise provided with a screw thread 70 which is cooperable with a screw thread 72 that is provides to the exterior surface of the housing 65 of the rollover switch assembly 50. In this regard, the locking collar 65 is to be screwed onto the rollover switch assembly 50 until the locking collar 65 becomes frictionally engaged with the mounting collar 54 to thereby prevent the rollover switch assembly 50 from moving relative to the mounting collar 54. For ease of installing the locking collar 65 upon the rollover switch assembly, the locking collar 65 may be provided with one or more flanges 76. The one or more flanges 76 are provided to be grasped by a user or a tool to thereby allow the user or the tool to quickly rotate the locking collar 65 relative to the rollover switch assembly 50. It will also be appreciated that the flanges 76 can be omitted with the outer surface of the locking collar 65 instead being provided with a hexagonal or the like shape having one or more relatively flat or non-outwardly rounded surfaces for this same purpose.

For sensing when an object rolls over the rollover switch assembly 50 when properly installed on a playfield 14 as described above, the rollover switch assembly 50 includes a cover element 66 which is preferably in the shape of a star. It will be understood, however, that this shape is not intended to be limiting. The cover element 66 is positioned within a complementary opening 80 provided to an upper housing section 65A of the housing 65 such that at least a portion of the cover element 66 extends above a top surface of the upper housing section 65A to thereby allow the cover element 66 to be exposed for contact with and depression by a ball rolling thereover. The cover element 66 is coupled to a post 82 and the post 82 floats upon a spring 84 which rests upon a bottom surface of a lower housing section 86B. In this regard, the spring 84, which is biased to maintain the cover element 66 in its exposed position relative to the upper housing section 65A, preferably encircles an opening in the lower housing section 68B though which extends a bottom end of the post 82. For coupling the cover element 66 to the post 82, the cover element 66 may be provided with a cutout for receiving a top end of the post 82, e.g., via use of friction fit or more permanent fit as desired. Fasteners 86 or the like can be used to releasable couple the lower housing section 68B to the upper housing section 68A to thereby form the housing 68 for the cover element 66, post 82, and spring 84.

Positioned adjacent to the opening through which the bottom end of the post 82 is extendable is a printed circuit board (PCB) 88. While not required, the PCB 88 can be attached to the underside of the lower housing section 65B by use of fasteners 90 or the like. The PCB 88 carries a switch 96 which is positioned adjacent to the opening in the lower housing section 65B. Preferably, the switch 96 is in the form of an optical switch. In this manner, when an object rolls over the cover element 66 of the switch assembly 50 as installed on the playfield 14, the object will force the cover element 66 to move the post 82, against the biasing force of the spring 84, and thereby drive the post 82, via the opening in the lower housing section 65B, to a position where the end of the post 82 will activate the switch 66, e.g., to a position that will break the optical connection of the optical switch. Activation of the switch in this manner will cause the PCB 88 to generate a signal for use by the processing device 42 as described above. For allowing the PCB 88 to be releasably coupled to the processing device 42, the PCB 88 preferably includes a modular, wire/bus receiving connector 92.

While not required, the PCB 88 may additionally support one or more light emitting diodes (LEDs) 100. The LEDs 100 may be multicolored LEDs and may be used to illuminate the entire switch assembly 84 or the cover element 66 alone. To this end, the entire switch assembly 50 may be molded from clear plastic materials or the cover element 66 (and other elements excepting the upper housing section 65A) may be molded from clear plastic materials in keeping with the desired illumination needs.

From the foregoing, it will be appreciated that the subject rollover switch provides various advantages over the prior art. For example, the described rollover switch assembly 50 allows the mounting collar 54 to be installed with the position of the switch assembly 50 then being finely adjusted to thereby ensure that the upper housing 65A of the switch assembly 50 is positioned flush with the critical top surface of the playfield board after the playfield board has gone thru all of its finishing operations. In addition, the adjustability of the described rollover switch assembly 50 allows the subject rollover switch assembly 50 to be used with playfield boards of varying thickness. Still further, the described rollover switch assembly 50 provides a self-contained sensor package that reduces the required footprint of the device relative to previous implementations, the described use of an optical sensor eliminates the need to adjust the switch, the described use of a modular connector housing increases reliability and ease of manufacturing and service, the described use of surface mount componentry minimizes the package and provides superior reliability, the described compact nature of the overall device gives the game designer greater freedom and allows a designer to place the game device in crowded areas of the playfield to enhance game play, and the described method for making the device provides an assembly that can be quickly and easily disassembled for service or replacement.

While a specific embodiment of the invention has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A rollover switch assembly for use with an amusement game having a playfield and an object which moves across a first surface of the playfield, comprising:

a mounting collar arranged to be attached to a second surface of the playfield and sized to be positioned within an opening formed in the playfield wherein the opening extends between the second surface of the playfield and the first surface of the playfield; and a switch assembly having a housing, the housing carrying a depressible cover, a switch, a post element, and a spring, wherein the post element is disposed within the housing so as to extend from the depressible cover to the switch and the spring is coupled to the post element to bias the post element away from a position of activation of the switch whereby a depression of the cover in response to contact being made between the cover and the object functions to move the post element within the housing to the position of activation of the switch against the bias of the spring to thereby activate the switch;

wherein the mounting collar and the housing of the switch assembly have cooperating features that allow the switch assembly to be adjustably mounted within the mounting collar to thereby allow the housing, the cover, the switch, the post element, and the spring to be positioned at a desired location relative to the mounting collar and, accordingly, at a desired location relative to the first surface of the playfield.

2. The rollover switch assembly as recited in claim 1, wherein the cooperating elements comprise a first screw thread provided to an interior surface of the mounting collar and a second screw thread provided to an exterior surface of the housing.

3. The rollover switch assembly as recited in claim 2, further comprising a locking collar positionable over the housing and engagable with the mounting collar and the housing to prevent movement of the housing relative to the mounting collar when the switch assembly is positioned as desired within the mounting collar.

4. The rollover switch assembly as recited in claim 3, wherein the locking collar has a third screw thread provided to an interior surface of the locking collar and the housing has a fourth thread provided to the exterior surface of the housing and wherein the third screw thread and the fourth screw thread cooperate to position the locking collar over the housing.

5. The rollover switch assembly as recited in claim 4, wherein the locking collar has one or more flanges extending therefrom to provide surfaces for use in grasping the locking collar to rotate the locking collar relative to the housing.

6. The rollover switch assembly as recited in claim 4, wherein the locking collar has one or more flat surfaces for use in grasping the locking collar to rotate the locking collar relative to the housing.

7. The rollover switch assembly as recited in claim 1, wherein the switch comprises an optical switch and wherein depression of the cover causes the post element to move in a direction that will activate the optical switch.

8. The rollover switch assembly as recited in claim 7, comprising a printed circuit board which carries the optical switch, the printed circuit board being mounted to a surface of the housing opposite the cover.

9. The rollover switch assembly as recited in claim 8, comprising a modular connector mounted to the printed circuit board for releasably coupling the optical switch to a processing unit of the amusement game.

10. The rollover switch assembly as recited in claim 8, comprising at least one light emitting diode mounted to the printed circuit board for illuminating at least one of the cover and the housing of the optical switch assembly.

11. The rollover switch assembly as recited in claim 10, wherein at least one of the cover and the housing of the optical switch assembly comprises a translucent plastic material.

12. The rollover switch assembly as recited in claim 10, wherein the at least one light emitting diode comprises a multicolor light emitting diode.

13. The rollover switch assembly as recited in claim 1, wherein the mounting collar comprises at least one mounting flange having a fastener accepting opening for receiving a fastener for mounting the mounting flange to the second surface of the playfield.

14. An amusement game, comprising:

a playfield having a first surface, a second surface, and an opening that extends between the first surface and the second surface;

an object which moves across the first surface of the playfield; and a rollover switch, comprising:

a mounting collar arranged to be attached to the second surface of the playfield and sized to be positioned within the opening; and a switch assembly having a housing, the housing carrying a depressible cover, a switch, a post element, and a spring, wherein the post element is disposed within the housing so as to extend from the depressible cover to the switch and the spring is coupled to the post element to bias the post element away from a position of activation of the switch whereby a depression of the cover in response to contact being made between the cover and the object functions to move the post element within the housing to the position of activation of the switch against the bias of the spring to thereby activate the switch;

wherein the mounting collar and the housing of the switch assembly have cooperating features that allow the switch assembly to be adjustably mounted within the mounting collar to thereby allow the housing, the cover, the switch, the post element, and the spring to be positioned at a desired location relative to the mounting collar and, accordingly, at a desired location relative to the first surface of the playfield.

15. The amusement game as recited in claim 14, wherein the cooperating elements comprise a first screw thread provided to an interior surface of the mounting collar and a second screw thread provided to an exterior surface of the housing.

16. The amusement game as recited in claim 15, further comprising a locking collar positionable over the housing and engagable with the mounting collar and the housing to prevent movement of the housing relative to the mounting collar when the switch assembly is positioned as desired within the mounting collar.

17. The amusement game as recited in claim 16, wherein the locking collar has a third screw thread provided to an interior surface of the locking collar and the housing has a fourth thread provided to the exterior surface of the housing and wherein the third screw thread and the fourth screw thread cooperate to position the locking collar over the housing.

18. The amusement game as recited in claim 17, wherein the locking collar has one or more flanges extending therefrom to provide surfaces for use in grasping the locking collar to rotate the locking collar relative to the housing.

19. The amusement game as recited in claim 17, wherein the locking collar has one or more flat surfaces for use in grasping the locking collar to rotate the locking collar relative to the housing.

20. The amusement game as recited in claim 15, wherein the switch comprises an optical switch and wherein depression of the cover causes the post element to move in a direction that will activate the optical switch.

21. The amusement game as recited in claim 20, comprising a printed circuit board which carries the optical switch, the printed circuit board being mounted to a surface of the housing opposite the cover.

22. The amusement game as recited in claim 15, wherein the mounting collar comprises at least one mounting flange having a fastener accepting opening for receiving a fastener for mounting the mounting flange to the second surface of the playfield.

* * * * *